US005494305A

United States Patent [19]

Chen

[11] Patent Number: 5,494,305

[45] Date of Patent: Feb. 27, 1996

[54] FOLDABLE FITTER'S TROLLEY WITH A DRAWER MEMBER

[76] Inventor: Shou-Te Chen, No. 63-1, Alley 11, Lane 22, Sec. 1, Hsin-Jen Rd., Tai-Ping Hsiang, Taichung Hsien, Taiwan

[21] Appl. No.: 324,565

[22] Filed: Oct. 18, 1994

[51] Int. Cl.[6] ..... B25H 5/00

[52] U.S. Cl. ..... 280/32.6; 280/37

[58] Field of Search ..... 280/32.6, 32.5, 280/639, 37

[56] References Cited

U.S. PATENT DOCUMENTS

| | | | |
|---|---|---|---|
| 2,487,706 | 11/1949 | Happ | 280/32.6 |
| 2,689,744 | 9/1954 | Mullin | 280/32.6 |
| 2,692,636 | 10/1954 | Morrison | 280/32.6 |
| 3,677,569 | 7/1972 | Larson | 280/32.6 |
| 4,889,352 | 12/1989 | Chamberlin, Jr. et al. | 280/32.6 |
| 4,986,558 | 1/1991 | Morris | 280/32.6 |
| 5,297,809 | 3/1994 | Chen | 280/32.6 |
| 5,330,211 | 7/1994 | Nicholson | 280/32.6 |

FOREIGN PATENT DOCUMENTS

| | | | |
|---|---|---|---|
| 963389 | 7/1964 | United Kingdom | 280/32.6 |
| 2178702 | 2/1987 | United Kingdom | 280/32.6 |

*Primary Examiner*—Kevin T. Hurley

*Attorney, Agent, or Firm*—Panitch Schwarze Jacobs & Nadel

[57] ABSTRACT

A fitter's trolley includes an elongated plate member, a number of casters mounted to the lower side face of the elongated plate member, and a drawer member mounted slidably to the lower side face of the elongated plate member. The elongated plate member of the fitter's trolley is formed of a front panel and a rear panel which is hinged to the front panel, so that the fitter's trolley can be folded when the front and rear panels are rotated toward each other.

3 Claims, 6 Drawing Sheets

FOLDABLE FITTER' S TROLLEY WITH A DRAWER MEMBER

BACKGROUND OF THE INVENTION

1. Field of the Invention

This invention relates to a fitter's trolley, more particularly to a foldable fitter's trolley having a drawer mounted thereto.

2. Description of the Related Art

In the past, a fitter who uses hand and machine tools to fit and/or repair parts of an automobile usually lies on a fitter's trolley in order to slide under and out from the bottom of the automobile. A conventional fitter's trolley is shown in FIG. 1, which includes an elongated plate member 11 and a number of casters 12 mounted to the lower side face of the elongated plate member 11. Two support rods 13 extend from one end of the elongated plate member 11 and a tubular illuminating device 14 is supported by the support rods 13. The tubular lamp device 14 is provided for illuminating purposes when a fitter is working under the bottom of an automobile.

However, such a conventional fitter's trolley suffers from the following disadvantages:

(1) When lying on the fitter's trolley and working under the bottom of an automobile, a fitter must frequently slide into and out of the space below the bottom of the automobile to pick up or replace the hand and machine tools spread over the ground near the automobile. This inconveniences the fitter and increases working time.

(2) The conventional fitter's trolley is bulky and inconvenient to store and carry outdoors.

SUMMARY OF THE INVENTION

It is therefore a main object of this invention to provide a fitter's trolley which allows the fitter to conveniently pick up and replace the tools.

It is another object of this invention to provide a fitter's trolley which is compact and is easy to store and carry outdoors.

Accordingly, an aspect of this invention is that the fitter's trolley comprises an elongated plate member, a number of casters mounted to the lower side face of the elongated plate member, and a drawer member slidably mounted to the lower side face of the elongated plate member.

Another aspect of this invention is that the elongated plate member of the fitter's trolley is formed of a front panel and a rear panel which is hinged to the front panel, so that the fitter's trolley can be folded when the lower side faces of the front and rear panels are rotated toward each other.

Other features and advantages of this invention will become apparent in the following detailed description of the preferred embodiments of this invention with reference to the accompanying drawings.

DETAILED DESCRIPTION OF THE PREFERRED EMBODIMENTS

Figure 1:
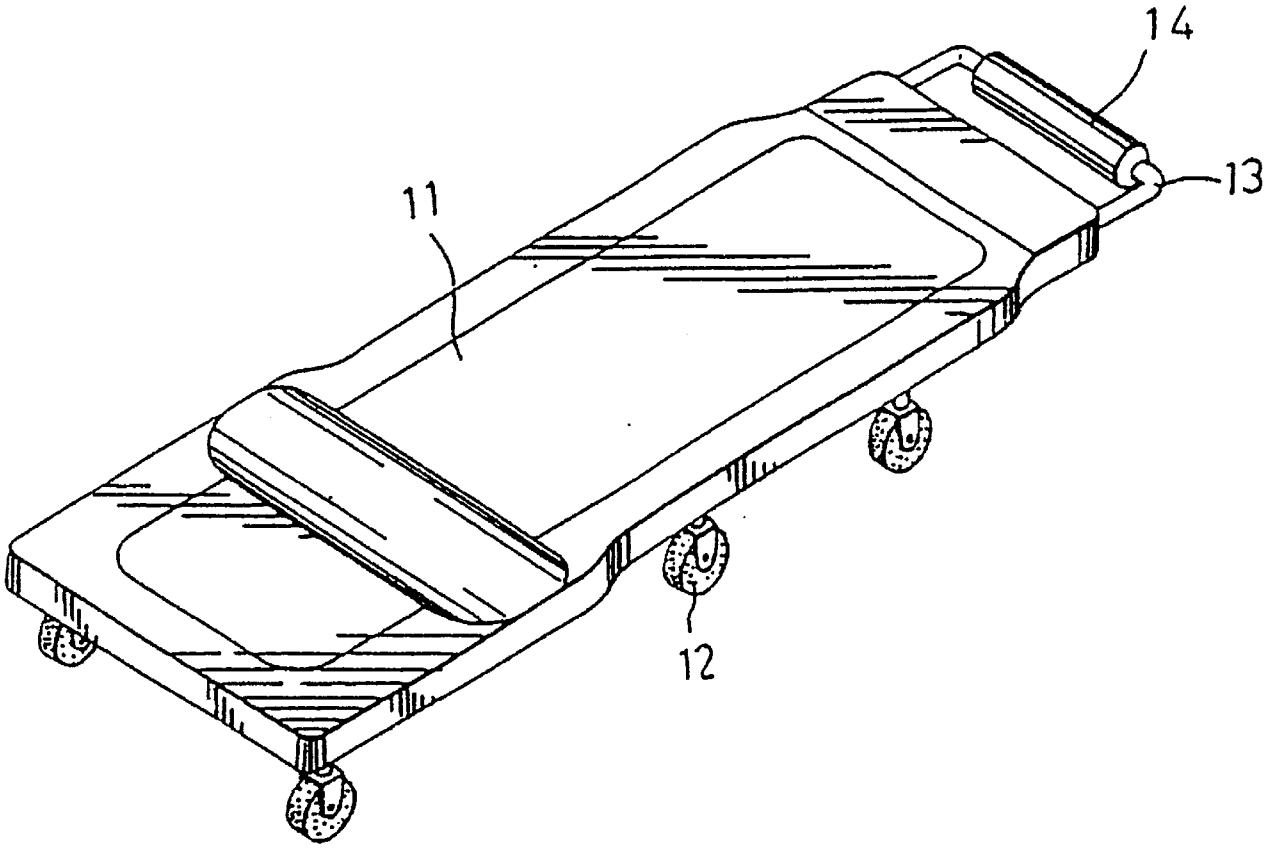
FIG. 1 (PRIOR ART)
FIG. 1 is a perspective view of a conventional fitter's trolley.
Figure 2:
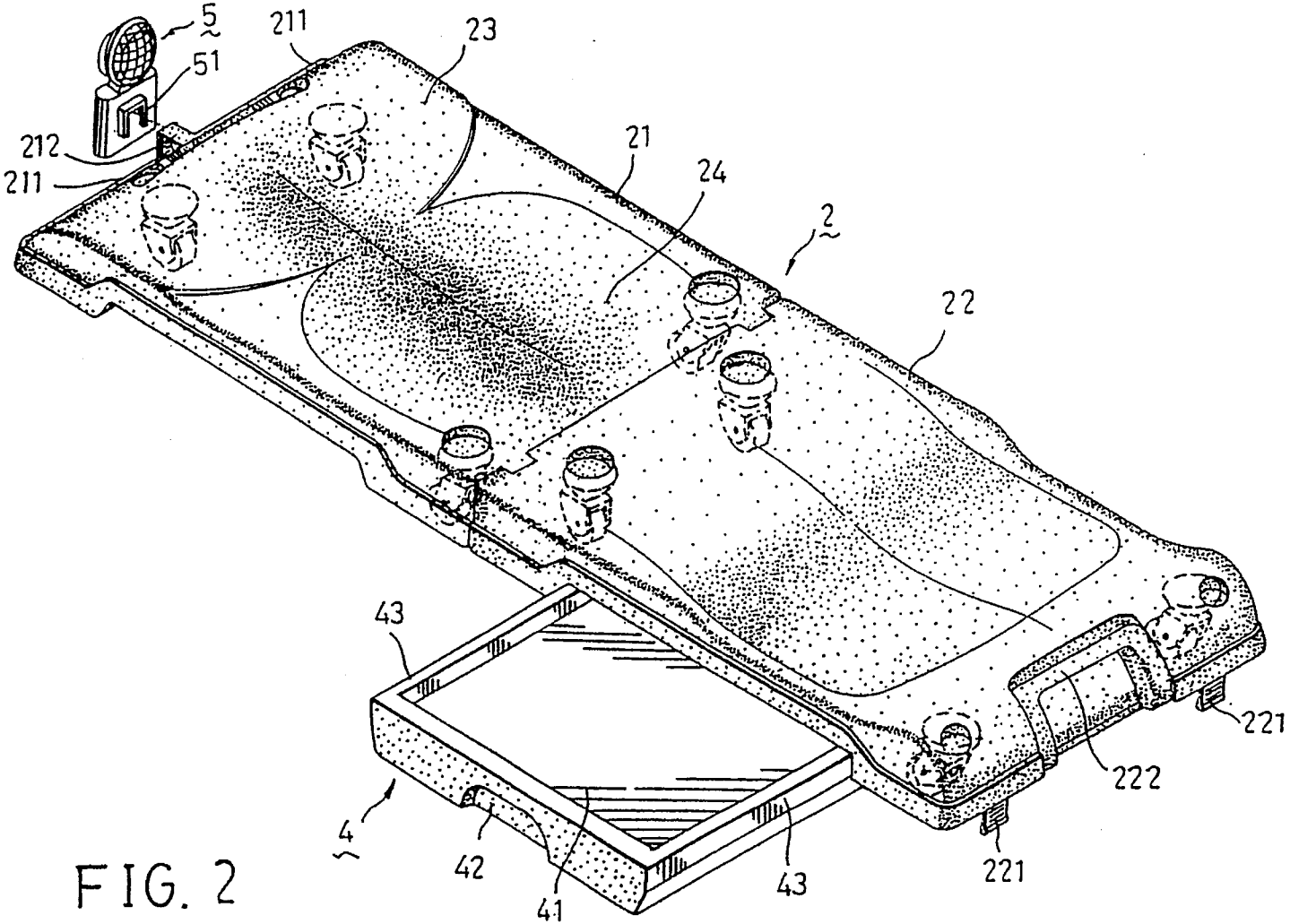
FIG. 2 is a perspective schematic view of a first preferred embodiment of a fitter's trolley of this invention, with the drawer member being partially pulled out.
Figure 3:
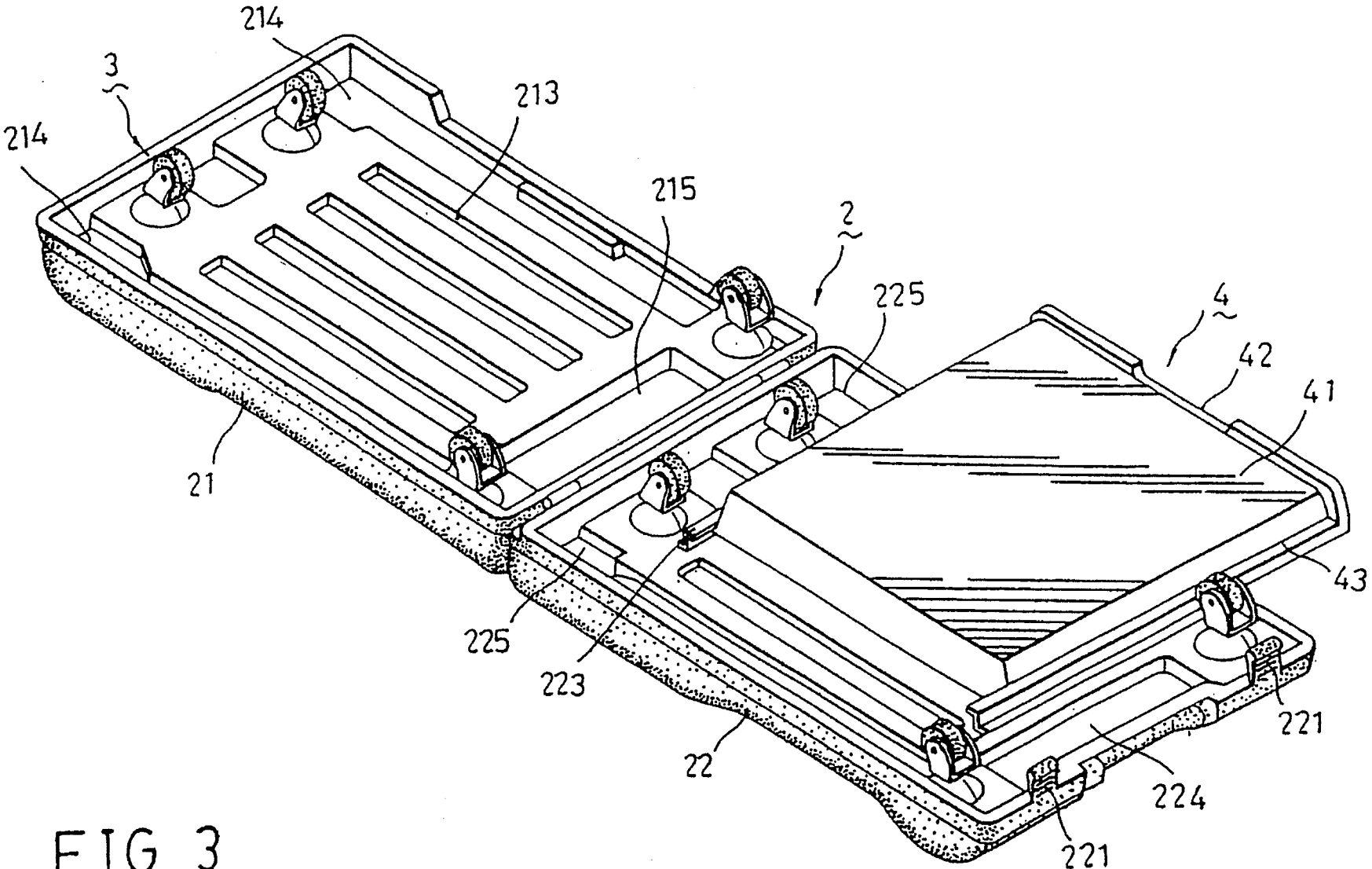
FIG. 3 is a perspective schematic view illustrating the bottom side of the fitter's trolley of FIG. 2.

Referring to FIGS. 2 and 3, the first preferred embodiment of a fitter's trolley of this invention includes an elongated plate member 2, a number of casters 3 and a drawer member 4.

Figure 4:
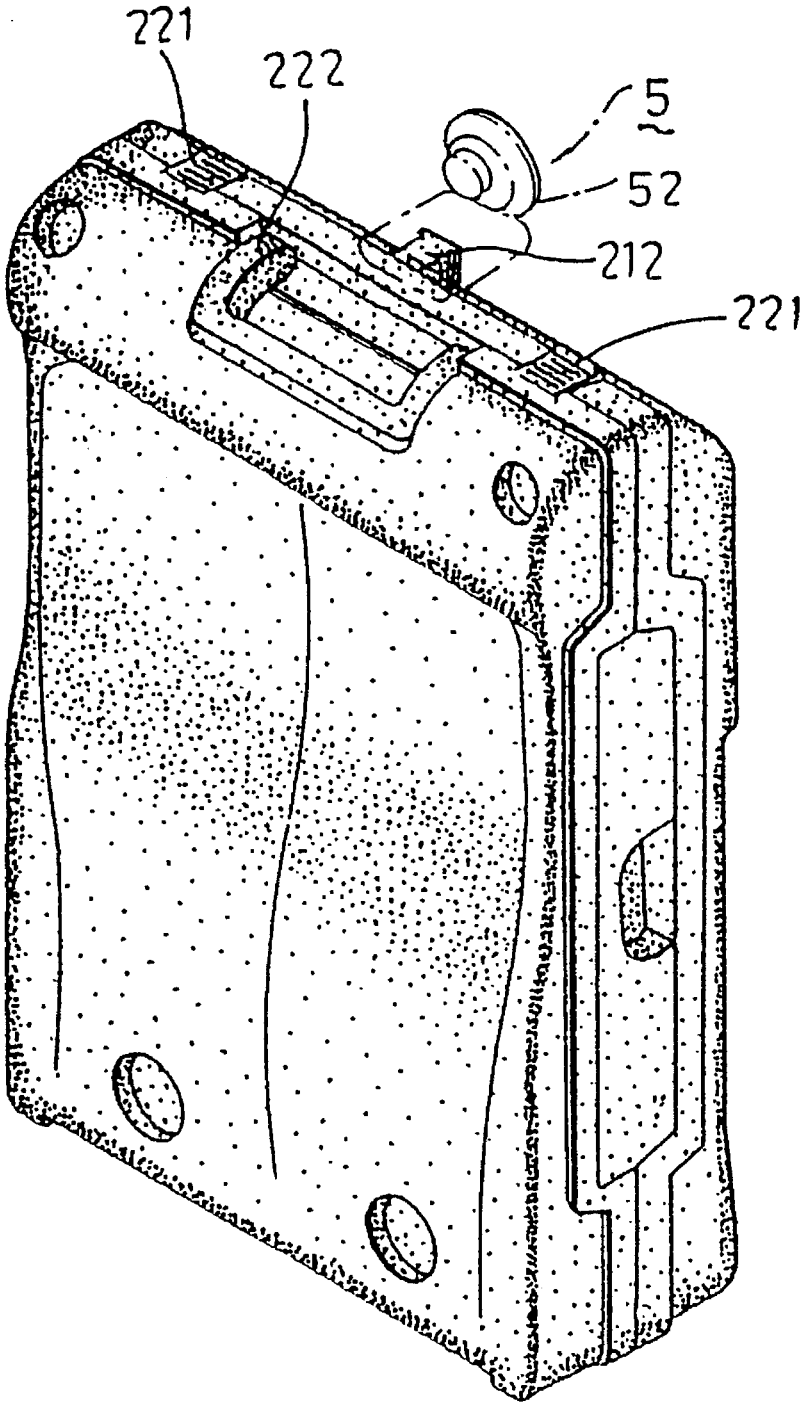
FIG. 4 is a perspective view illustrating the fitter's trolley of FIG. 2 in a folded position.

The elongated plate member 2 is formed of a front panel 21 and a rear panel 22 which is hinged to the front panel 21. In a folded position, the lower side faces of the front and rear panels 21, 22 of the elongated plate member 2 may be rotated toward each other until they are touching. The front end of the front panel 21 has a projected portion 23 which servers as a pillow and the upper side face of the elongated plate member 2 has recessed portions 24 so as to conform with the outline of a fitter's body when the elongated plate member 2 is in an extended position, as shown in FIG. 2. The front end of the front panel 21 has a pair of first engaging members 211 formed thereon. In this embodiment, the first engaging members 211 are in the form of two ridges. A tenon 212 protrudes between the first engaging members 211. The tenon 212 is adapted to be inserted into an engaging groove 51 of a lamp device 5. The lower side face of the front panel 21 has a plurality of parallel reinforcing ribs 213 formed in the middle section of the front panel 21, as best illustrated in FIG. 3. Two cavities 214 are formed at the corners of the lower side face of the front panel 21 and an elongated cavity 215 is formed near the hinge connection of the front and rear panels 21, 22. The rear panel 22 has a pair of second engaging members 221 formed at the rear end of the rear panel 22. In this embodiment, the second engaging members 221 are in the form of two tabs or snap fingers. The first and second engaging members 211, 221 are correspondent to one another so as to form a snap-in connection therebetween to hold the trolley closed when the elongated plate member 2 is folded, as best illustrated in FIG. 4.

Referring now to FIG. 2, a handle is pivotally connected to the rear end of the rear panel 22 between the two snap fingers 221. The lower side face of the rear panel 22 has two slide rails 223 fixed thereto, as best illustrated in FIG. 3. An elongated cavity 224 is formed near the middle portion of the rear end of the rear panel 22. Two cavities 225 are formed at the corners of the lower side face of the rear panel 22 near the hinge connection of the front and rear panels 21, 22.

Referring to FIG. 2, the casters 3 are attached to the lower side of the elongated plate member 2. More specifically, the casters 3 are situated respectively near the inside of the cavities 214, 225 and near the ends of the elongated cavities 215, 224.

In this embodiment, the drawer member 4 is a generally rectangular box 41 with an open top. The rectangular box has a recessed pull portion 43 on the front wall in order to allow a user to easily grasp and pull the rectangular box 42 out. Two projections are formed on the opposite side walls of the rectangular box 42 and mounted to the slide rails 223 of the rear panel 22 so that the rectangular box 41 can slide between and along the two slide rails 223, as best illustrated in FIG. 3.

When in use, the elongated plate member 2 is in an extended position, that is, the front and rear panels 21, 22 are rotated away from one another, as shown in FIG. 2. The tenon 212 of the front panel 21 is inserted into the engaging groove of a lamp device 5. A fitter can lie on the extended plate member 2 and move under the bottom of an automobile by the use of the casters 3. The fitter can then use the hand and machine tools stored in the drawer member 4 and the lamp device 5 to maintain and/or repair the automobile.

When finishing the maintenance and/or repair of the automobile, the fitter pushes the drawer 4 completely under the rear panel 22 of the elongated plate member 2 and then detaches the engaging groove 51 of the lamp device 5 from the tenon 212 on the front panel 21 of the elongated plate member 2. Next, the front and rear panels 21, 22 are rotated toward one another so that the elongated plate member 2 can be folded. In this position, the casters 3 near the cavities 214, 225 are respectively and correspondingly received in the elongated cavities 215, 224. The caster 3 near the elongated cavities 215, 224 are respectively and correspondingly received in the cavities 214, 225. The first and second engaging members 211, 221 are locked together, as best illustrated in FIG. 4. It should be noted that this folding trolley is compact to store and the user may easily carry the trolley by the handle 222.

From the aforementioned description of the features, it can be seen that the trolley of this invention has the following advantages:

(1) When lying on the fitter's trolley and working under the bottom of an automobile, the fitter need neither spread the hand and machine tools over the ground nor slide out from the bottom of the automobile to pick or replace the hand and machine tools.

(2) After finishing the maintaining or repairing work, the fitter can fold the elongated plate member of the fitter's trolley and lock it in the folded position by snapping the snap fingers 221 onto the ridges 211. Therefore, the fitter's trolley of this invention can be folded into a compact casing and be carried conveniently by hand.

Figure 5:
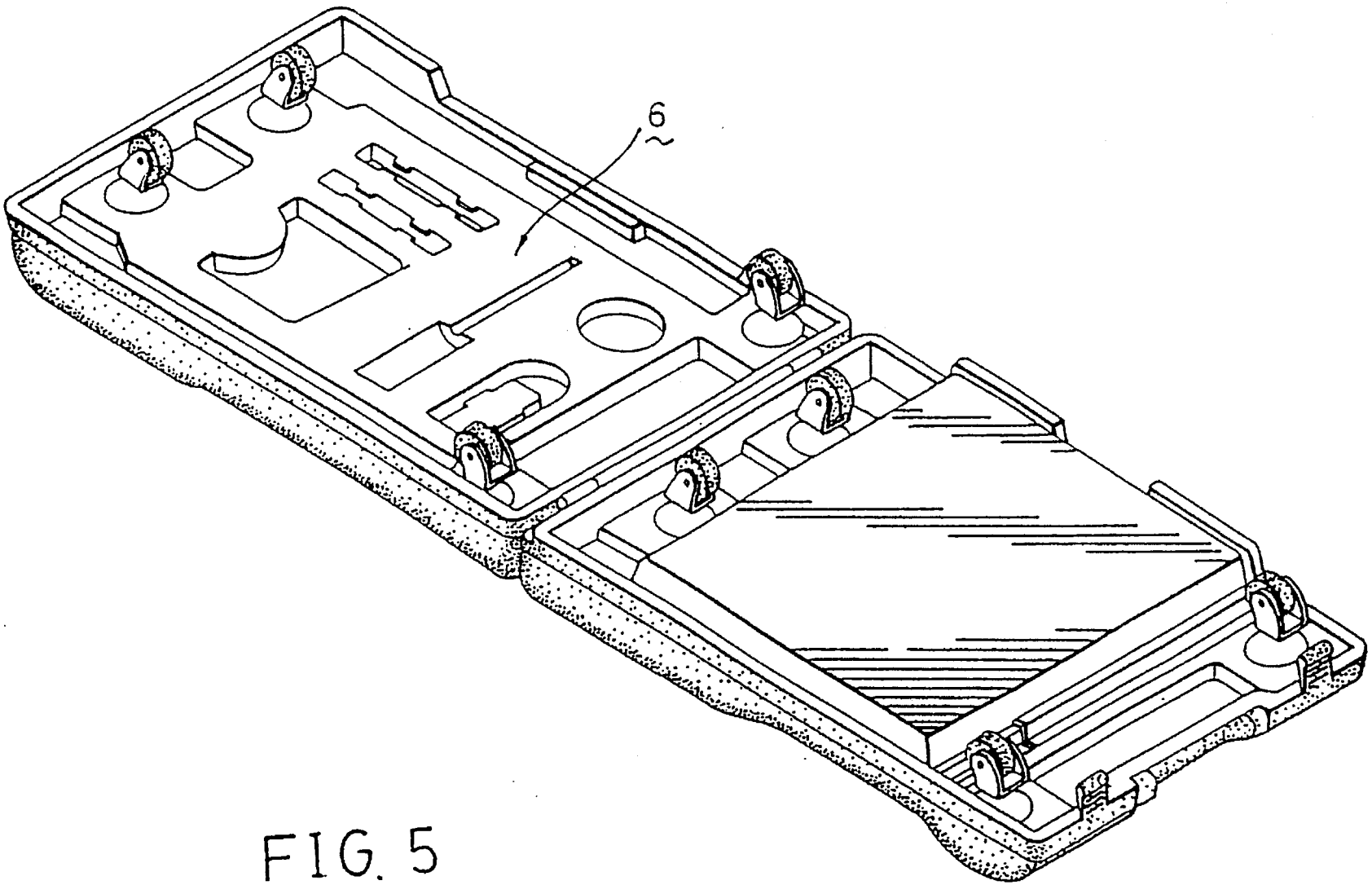
FIG. 5 is a perspective schematic view illustrating a second preferred embodiment of the bottom side of a fitter's trolley of this invention.

FIG. 5 shows a second preferred embodiment of a fitter's trolley of this invention. In this embodiment, the structure of the fitter's trolley is similar to that of the fitter's trolley of the first embodiment except that the lower side face of the front panel 2 is provided with a number of recesses 6. The recesses 6 are designed to have various outlines of the tools in order to receive tools. Therefore, the fitter's trolley of this invention can be used as a tool box when it is folded.

Figure 6:
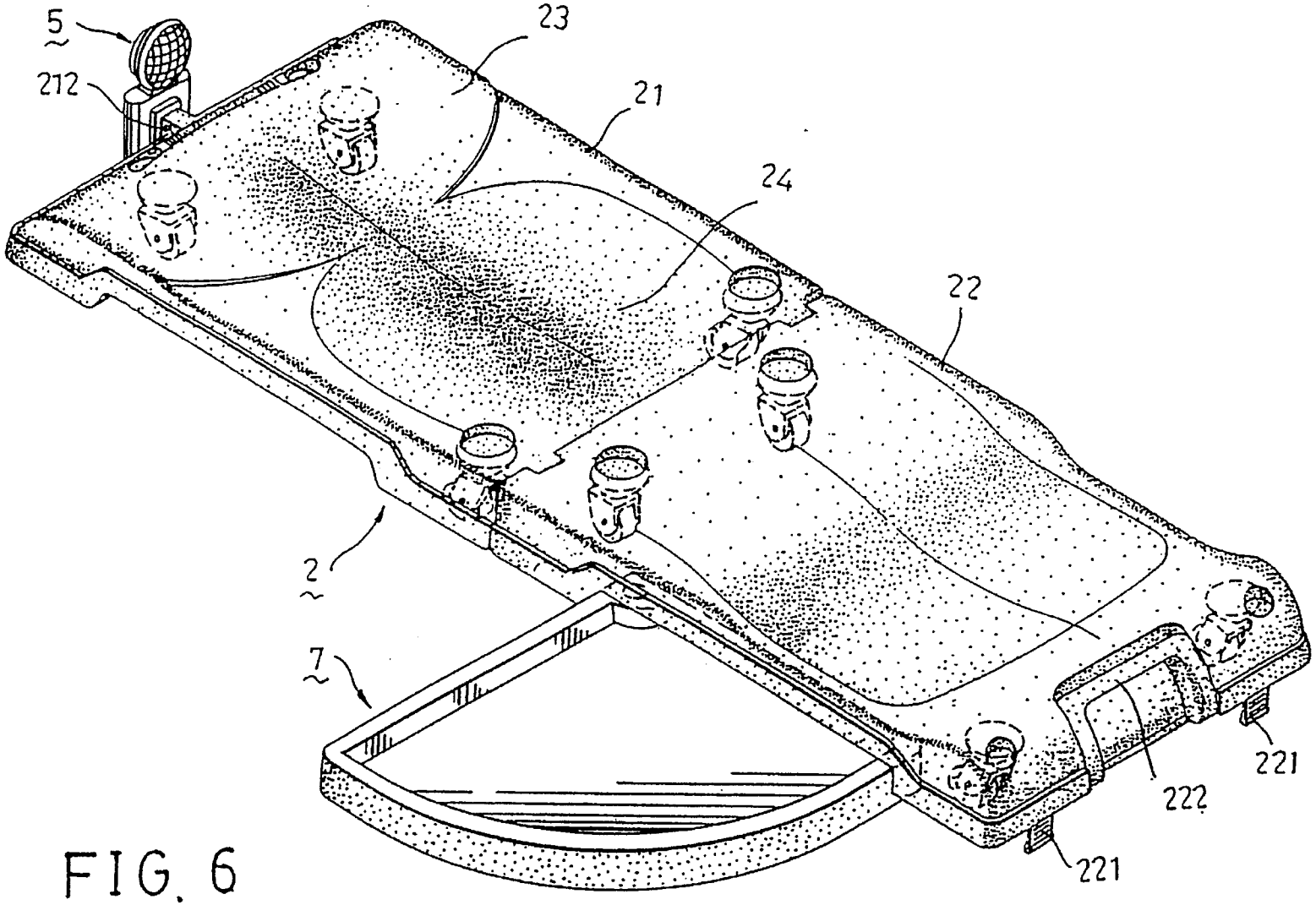
FIG. 6 is a perspective schematic view of a third preferred embodiment of a fitter's trolley of this invention, with the drawer member being pulled out.

FIG. 6 shows a third preferred embodiment of a fitter's trolley of this invention. In this embodiment, the structure of the fitter's trolley is similar to that of the fitter's trolley of the first embodiment except that the drawer 4 is in the form of a sectorial box 7. The box 7 is pivotally connected to the lower side face of the rear panel 22. Therefore, the fitter can more conveniently pull the sectorial box 7 out and take the hand and machine tools out.

In addition, when the fitter's trolley of this invention is in the folded position, as illustrated in FIG. 4, the lamp device 52 can be connected to the tenon 212 as mentioned above and the rotatable lamp 52 can be rotated to a predetermined position as desired. Therefore, the lamp device 5 can be used as a signaling device.

With this invention thus explained, it is apparent that numerous modifications and variations can be made without departing from the scope and spirit of this invention. It is therefore intended that this invention be limited only as indicated in the appended claims.

I claim:

1. A fitter's trolley comprising:

an elongated plate member with an upper side face which is adapted to conform with a fitter's body outline, and a lower side face;

a plurality of casters mounted to said lower side face of said elongated plate member;

a drawer member mounted slidably to said lower side face of said elongated plate member; and a tenon protruding from an end of said elongated plate member, said tenon being adapted for insertion into an engaging groove of a lamp device.

2. A fitter's trolley comprising:

an elongated plate member formed from a front panel and a rear panel, each panel having an upper side face and a lower side face, the upper side faces of the front and rear panels being adapted to conform with a fitter's body outline, the rear panel being hinged to the front panel so that said elongated plate member can be folded when said lower side faces of said front and rear panels are rotated toward each other;

a plurality of casters mounted to said lower side faces of said front and rear panels;

said lower side faces of said front and rear panels having a plurality of cavities formed therein, said cavities of said front and rear panels corresponding to and receiving said casters respectively when said elongated plate member is folded; and a drawer member mounted slidably to said lower side face of one of said front and rear panels.

3. A fitter's trolley comprising:

an elongated plate member formed from a front panel and a rear panel, each panel having an upper side face and a lower side face, the upper side faces of the front and rear panels being adapted to conform with a fitter's body outline, the lower side face of one of said front and rear panels having a plurality of recesses formed therein, said recesses being adapted to receive tools, the rear panel being hinged to the front panel so that said elongated plate member can be folded when said lower side faces of said front and rear panels are rotated toward each other;

a plurality of casters mounted to said lower side faces of said front and rear panels;

a drawer member mounted slidably to said lower side face of one of said front and rear panels.

* * * * *